US007487566B2

(12) United States Patent
McKay, Jr. et al.

(10) Patent No.: US 7,487,566 B2
(45) **Date of Patent: *Feb. 10, 2009**

(54) ADHESIVE ROLLER

(75) Inventors: Nicholas D. McKay, Jr., Atanta, GA (US); Mark Schmidt, Evans, GA (US)

(73) Assignee: The Evercare Company, Alpharetta, GA (US)

( * ) Notice: Subject to any disclaimer, the term of this patent is extended or adjusted under 35 U.S.C. 154(b) by 548 days.

This patent is subject to a terminal disclaimer.

(21) Appl. No.: 10/842,871

(22) Filed: May 11, 2004

(65) Prior Publication Data

US 2005/0050661 A1 Mar. 10, 2005

Related U.S. Application Data

(63) Continuation-in-part of application No. 10/655,101, filed on Sep. 4, 2003.

(51) Int. Cl.
*A47L 25/00* (2006.01)
*A47L 25/08* (2006.01)

(52) U.S. Cl. ..... 15/104.002

(58) Field of Classification Search ..... 15/104.002
See application file for complete search history.

(56) References Cited

U.S. PATENT DOCUMENTS 2,191,704 A * 2/1940 Bennett ..... 156/230
2,800,215 A * 7/1957 Converse ..... 400/702
3,417,418 A * 12/1968 Riboud ..... 15/104.002
4,895,746 A * 1/1990 Mertens ..... 428/40.2
4,905,337 A * 3/1990 McKay ..... 15/104.002
5,050,909 A * 9/1991 Mertens et al. ..... 283/81
5,411,168 A * 5/1995 Mertens et al. ..... 221/22
6,842,934 B1 * 1/2005 McKay et al. ..... 15/104.002
6,954,963 B2 * 10/2005 McKay ..... 15/104.002
2003/0039824 A1 2/2003 Aalbers
2003/0096074 A1 * 5/2003 Kim ..... 428/40.1

* cited by examiner

*Primary Examiner*—Randall Chin
(74) *Attorney, Agent, or Firm*—Gifford, Krass, Sprinkle, Anderson & Citkowski, P.C.

(57) ABSTRACT

An adhesive roller for detritus removal having an elongated strip where the strip has both a backing layer and an adhesive layer overlying and covering a first side of the backing layer. The strip also has a first end, a second end and two spaced apart sides. The strip is wound from its first end and to its second end into a tubular cylindrical roller with the adhesive layer facing outwardly. An adhesive release coating also overlies at least a portion of a second side of the backing layer. The adhesive release coating may be either applied as a liquid coating, or may be a solid substrate. This adhesive release coating facilitates removal of individual sheets from the roller. Alternatively, a portion of the backing layer is crimped to form alternating peaks and valleys along at least a portion of the backing layer. These alternating peaks and valleys limit the amount of areal contact between the backing layer and the next inner adhesive layer of the roller to facilitate removal of individual sheets from the roller.

14 Claims, 4 Drawing Sheets

ADHESIVE ROLLER

RELATED APPLICATION

This application is a continuation-in-part of U.S. patent application Ser. No. 10/655,101 filed Sep. 4, 2003, now pending.

BACKGROUND OF THE INVENTION

I. Field of the Invention

The present invention relates generally to adhesive rollers of the type used for detritus removal.

II. Description of Related Art

There are many previously known adhesive rollers used for detritus removal. These previously known rollers typically comprise an elongated strip having a backing layer. The strip includes two ends and two spaced apart and parallel sides.

An adhesive layer is provided along a first side of the backing layer. Thereafter, the strip is wound into a tubular and cylindrical roller with the adhesive layer facing outwardly. Oftentimes the strip is wound around a tubular core and the tubular core is then rotatably mounted on a handle to facilitate rolling of the adhesive roller along the surface desired to be cleaned.

After prolonged use of the adhesive roller for cleaning surfaces, the adhesive on the outermost adhesive layer or sheet of the adhesive roller becomes covered with detritus and other matter and loses its adhesiveness. When this happens, it is necessary to remove the outermost sheet of the adhesive roller to expose fresh adhesive on the next underlying sheet on the roller.

However, because of the adhesion of the backing strip with the adhesive on the next underlying layer on the roller, the actual removal of single sheets, each constituting one circumference of the roller, is oftentimes difficult. Frequently, the outermost sheet of the adhesive roller becomes torn during its removal. Even though a uniform release coating covers the side of the backing strip opposite from the adhesive side, these previously known uniform release coatings, however, are of a relatively weak strength in order to ensure the integrity of the roll in use.

There have, however, been a number of previously known adhesive roller constructions designed to facilitate the removal of an individual sheet corresponding to one revolution around the cylindrical roller when desired to expose fresh adhesive on the next underlying sheet. In one previously known adhesive roller, perforations are provided at spaced intervals along the roller so that the space in between the perforations corresponds substantially to one revolution of the adhesive roller. In still a further previously known adhesive roller, a single cut terminates at a position spaced inwardly from the sides of the adhesive roller to facilitate removal of individual sheets or layers of the adhesive roller.

Even with these previously known adhesive rollers having both spaced perforations and/or a cut formed through the roller to facilitate separation of individual sheets from the roller, it is still oftentimes difficult to initiate the removal of one sheet from the roller due to the adhesion of the backing layer of the outermost sheet with the adhesive on the next innermost layer of the roller. Consequently, in order to facilitate the initiation of the removal of an individual sheet from the roller, there have been previously known adhesive rollers which provide at least one and oftentimes two "dry" edges along the backing strip. These dry edges are uncovered with adhesive so that the edge of the outermost sheet can be easily grasped along the dry edge in order to initiate the removal of the outermost sheet from the roller.

These previously known adhesive rollers with dry edges, however, have not proven wholly satisfactory in use. One disadvantage of the dry edge is that it reduces the amount of area of the exposed adhesive on the outermost surface of the roller since the dry edges are not covered with an adhesive. As such, the efficiency of the adhesive roller is less than an adhesive roller in which the entire outwardly facing surface of the backing strip is covered with an adhesive.

A still further disadvantage of the previously known adhesive rollers is that it is difficult during the manufacturing process to maintain an accurate width of the dry edge along one or both of the edges of the strip. The inability to maintain an accurate and predetermined dimension for the width of the dry edges along the adhesive roller provides an aesthetically displeasing appearance for the consumer. Furthermore, zone coating of the adhesive on the backing layer to form the dry edge(s) significantly increases the manufacturing costs for the adhesive roller.

SUMMARY OF THE PRESENT INVENTION

The present invention provides an adhesive roller which overcomes all of the above-mentioned disadvantages of the previously known devices.

In brief, the adhesive roller of the present invention comprises an elongated strip having a backing layer constructed of any conventional material, such as paper, film, foam or cloth. The strip includes two ends and two spaced apart and generally parallel sides.

An adhesive coating is then applied across all or substantially all of a first or outer side of the backing layer. Thereafter, an adhesive release coating covers at least a portion of a second or inner side of the backing layer and this release coating has a release strength which varies laterally across the strip. Consequently, after the strip is wound into a cylindrical roller with the adhesive layer facing outwardly, the adhesive release coating between the backing layer and the next inner adhesive sheet reduces the adhesion between the backing layer and the next inner adhesive sheet thus allowing the sheets to easily separate from the roller when desired. Some adhesion, however, between the backing layer and the next inner adhesive sheet is necessary in order to maintain the integrity of the roller in use.

The adhesive release coating may take any of several embodiments. For example, in one embodiment, a strong adhesive release coating which provides minimal adhesion is provided only along the edges of the inner side of the backing layer. The strong adhesive release coating may overlie the conventional weak adhesive release coating or, alternatively, zone coating for both the strong and weak adhesive release coatings may be used to selectively cover portions. As such, the adhesive release coating prevents the edges of the roller from adhering together thus allowing the edges to be easily grasped to initiate the removal of individual sheets from the adhesive roller. Furthermore, this is accomplished even though the entire outwardly facing surface of the roller is covered with adhesive for maximum cleaning efficiency.

In yet another embodiment of the invention, the strong adhesive release coating is applied to the inner side of the backing layer in a pattern. This pattern may be either constant, i.e. covering a same percentage of the inner side of the backing layer across the entire surface of the backing layer, or may be laterally varied to alter the adhesion between the backing layer and the next inner adhesive layer. For example, in one preferred embodiment, the adhesive release coating is applied across the center of the backing layer so that the adhesive release coating covers only a relatively small percentage of the area of the center of the backing layer. In doing so, a relatively firm, but removable, adhesion is achieved between the center of the backing layer and the next innermost adhesive layer.

Conversely, the percent of coverage of the strong adhesive release coating is increased from the center of the strip towards its edges thus decreasing the adhesion between the backing layer and the next inner adhesive layer along the edges of the strip.

Alternatively, different adhesive release coatings of different strengths may be provided to different portions of the inner side of the backing layer by zone coating or by laying adhesive release coatings on top of each other. For example, an adhesive release coating of only minimal effectiveness may be provided along the center of the backing layer while an adhesive release coating which is much more effective, and thus results in less adhesion between the backing layer and the next innermost adhesive layer, is provided along the edges of the backing strip.

In still a further embodiment of the invention, the backing layer is mechanically crimped or embossed, either along its entire surface or in a pattern, thus providing alternating peaks and valleys along the backing layer. These peaks and valleys thus reduce the area of contact, and thus the adhesion, of the inner side of the backing layer with the next inner adhesive layer of the roller. Such crimping may be done in a lateral, longitudinal or a combination lateral and longitudinal pattern to provide different levels of adhesion between the backing strip and the next inner adhesive layer.

In still a further embodiment, a solid substrate is positioned along the inner side of the backing layer to vary the adhesion between the backing layer and the next inner adhesive layer.

In yet a further embodiment a tab is formed on the backing layer at intervals corresponding to a single revolution around the roll. A strong adhesive release coating is applied to the inside surface of the tab so that the tab exhibits little, if any, adhesion to the underlying surface. Consequently, in use the tab "pops up" from the roll and forms a convenient pull tab for initiating the removal of individual sheets from the roll when desired.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
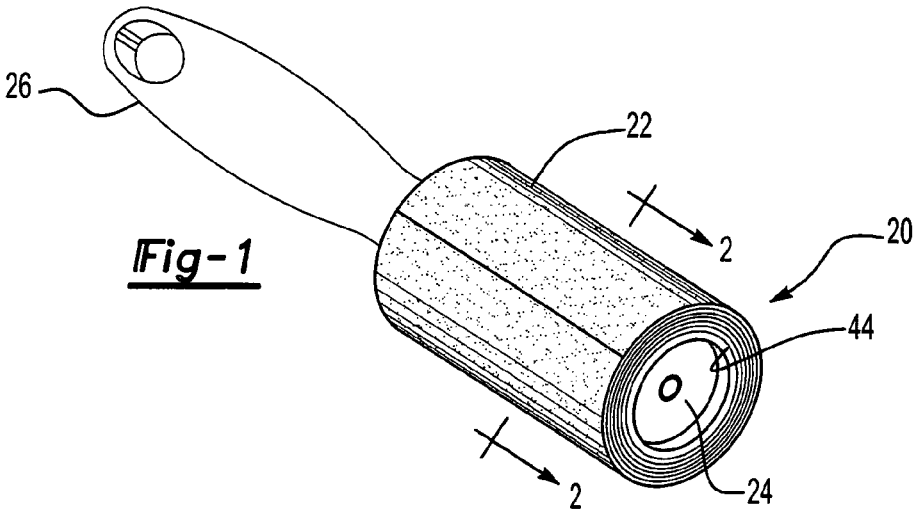
FIG. 1 is an elevational view illustrating a preferred embodiment of the present invention.
Figure 2:
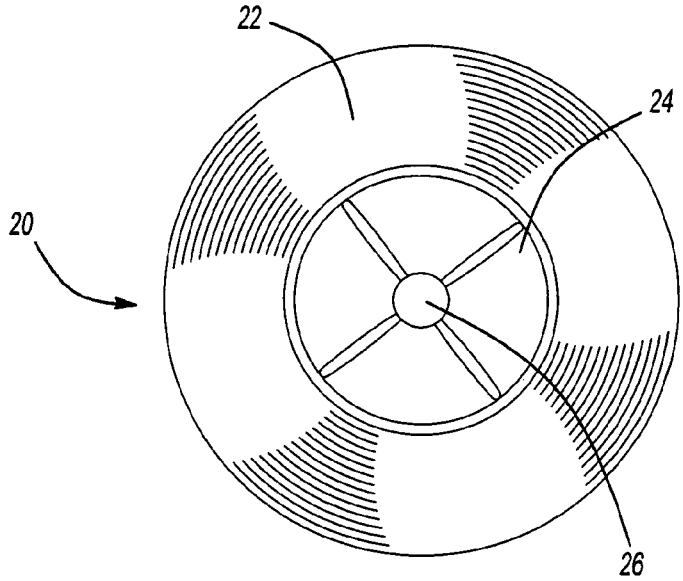
FIG. 2 is a sectional view taken substantially along line 2-2 in FIG. 1.

With reference first to FIGS. 1 and 2, a first preferred embodiment of the adhesive roller 20 of the present invention is shown in which the roller 20 is tubular and cylindrical in shape. The roller 20 preferably includes a tubular and cylindrical core 24 made of cardboard, plastic or other suitable material. The core 24 is then mounted on a handle 26 (FIG. 1) so that the adhesive roller 20 rotates freely with respect to the handle 26.

Figure 3:
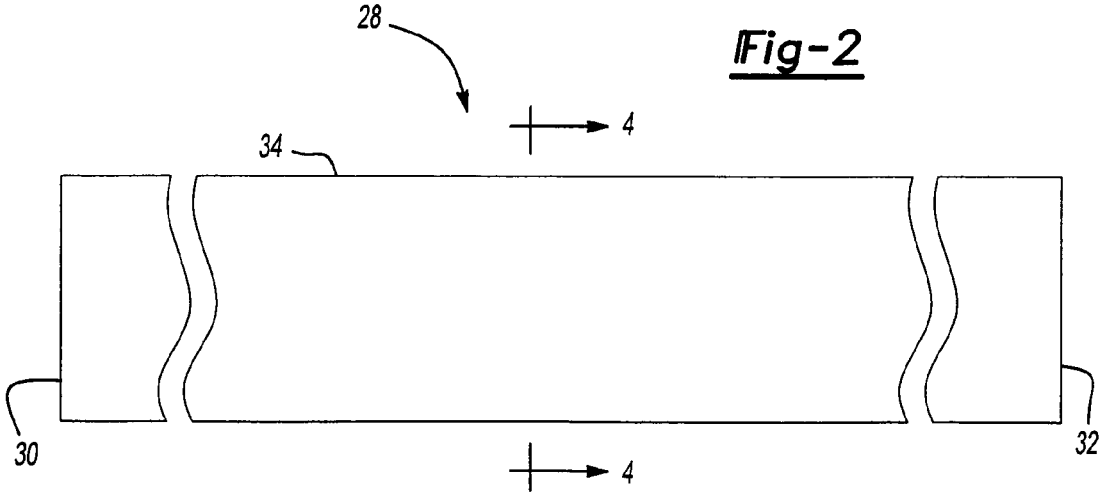
FIG. 3 is a plan view of a preferred embodiment of the invention prior to winding into a roller construction.
Figure 4:
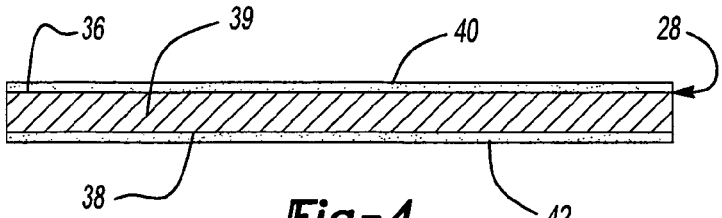
FIG. 4 is a sectional view taken substantially along line 4-4 in FIG. 1.

With reference now to FIGS. 3 and 4, the adhesive roller 20 comprises an elongated strip 28 having a first end 30, a second end 32, and two spaced apart and generally parallel sides 34. As best shown in FIG. 4, the strip 28 includes a backing layer 39 having a first or outer side 36 and second or inner side 38. The backing layer 39 may be constructed of any conventional material, such as paper. Additionally, the backing layer 39 may be made of paper, film, cloth, foam as well as other materials and mixtures thereof. In the event that the backing layer 39 is made of a porous material, such as paper, the backing layer is preferably saturated and/or sealed with a conventional sealant, such as a water-based latex sealant or solvent-based sealant.

An adhesive layer 40 is coated onto the first side 36 of the backing layer 39 50 that the adhesive layer 40 substantially covers the entire first side 36 of the backing layer 39. Any adhesive may be used for the adhesive layer 40.

An adhesive release coating 42 is also applied, in a fashion to be subsequently described in greater detail, along the second side 38 of the backing layer 39 such that the release coating 42 has a strength which varies laterally across the backing layer 39. The adhesive release coating 42 may be of any conventional composition, but preferably comprises a material selected from the group of fluoropolymers, silicone, wax, lacquer, paint, ink, soap, oil and mixtures thereof. The adhesive release coating 42 reduces the adhesion between the second side 38 of the backing layer 39 and the adhesive 40 on the next inner layer of the roller 20. The adhesive release coating 42 is preferably in liquid form as it is applied to the backing layer 39 and is preferably applied by zone coating although other coating methods may alternatively be used. However, unlike the previously known zone coating of the adhesive, high accuracy of zone coating the adhesive release coating is not required for aesthetic reasons since the adhesive release coating 42 is hidden while on the roll and not visible on the sheets when removed.

After application of both the adhesive layer 40 to the first or outer side 36 of the backing layer 39 and the release coating 42 to the second or inner side 38 of the backing layer 39, the strip 28 is wound into the cylindrical roller 20 illustrated in FIGS. 1 and 2 so that the adhesive layer 40 faces outwardly. In doing so, the strip 28 forms a plurality of overlying layers of the strip 28 as best shown in FIG. 2.

With reference again to FIGS. 1 and 2, each layer or revolution of the strip 28 on the roller 20 forms a single sheet on the adhesive roller 20. Conventional perforations 44 are provided at spaced intervals along the strip 28 corresponding to substantially one revolution of the strip 28 around the roller 22. Consequently, individual sheets from the strip 28 may be removed by ripping the sheet along the perforations in the desired fashion to expose the fresh adhesive on the next underlying inner sheet. Alternatively, a cut or series of cuts are formed in the roller construct 20 after it is wound into a roll in order to achieve easy separation of individual sheets from the roller 20. Similarly, in the event that the strip is spiral wound around the roller 20, the removal of one spiral winding of the strip exposes fresh adhesive around the outer surface of the roller 20.

Figure 5:
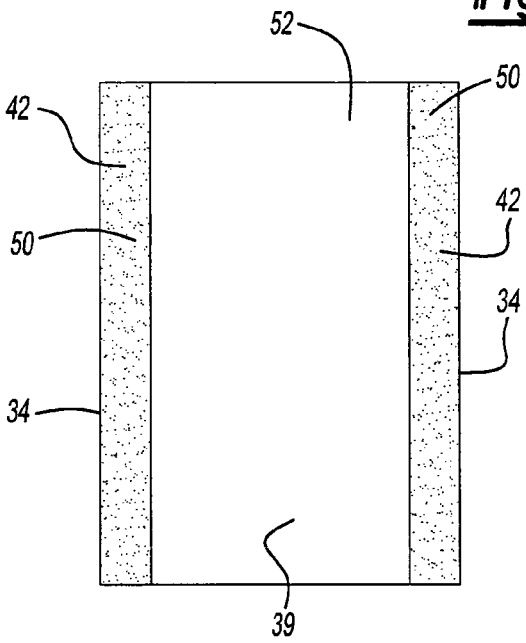
FIG. 5 is a plan view of the second or innermost side of the backing strip illustrating a first preferred embodiment of the present invention.

With reference now to FIG. 5, one embodiment of the invention is shown in which a highly effective adhesive release coating 42, i.e. an adhesive release coating which minimizes or eliminates adhesion, is applied in two zones 50 extending along the opposite sides 34 of the backing layer 39. A central portion 50 of the second side 38 of the backing layer 39 remains free of the highly effective adhesive release coating thereby relying entirely upon the inherent release quality of the backing layer 39 or, alternatively, is coated with a less effective adhesive release coating which reduces adhesion by an amount less than the highly effective release coating, but in an amount sufficient to minimize or eliminate shredding during removal of individual sheets from the roller 20. Consequently, when the strip illustrated in FIG. 5 is rolled into the cylindrical roller 20 illustrated in FIGS. 1 and 2, the adhesive release coating 42 prevents, or at least minimizes, adhesion of the backing layer 39 to the adhesive on the next inner layer of the roller 20 thus allowing the edges of the strip 28 to be easily grasped and separated from each other for individual sheet removal from the roller 20 when desired. Conversely, since the highly effective adhesive release coating 42 is not applied to the central portion 52 of the backing strip 39, the adhesion between the central portion 52 of the backing strip 39 and the adhesive layer on the next inner sheet of the roller 20 maintains the integrity of the adhesive roller 20 in use.

Figure 6:
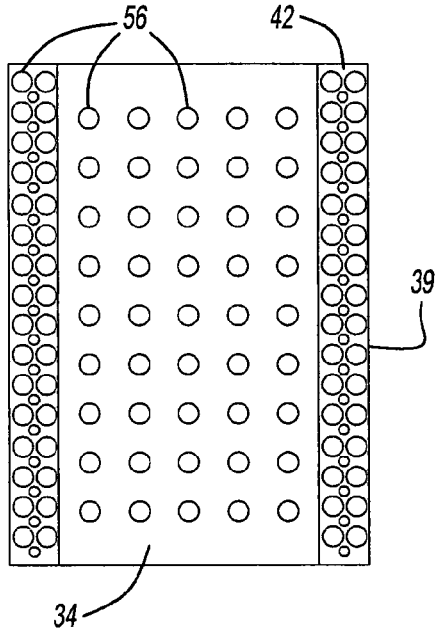
FIG. 6 is a view similar to FIG. 5 but illustrating a modification thereof.

With reference now to FIG. 6, a still further embodiment of the present invention is there shown in which the highly effective adhesive release coating 42 is applied to the second side 38 of the backing layer 39 in a pattern 56 such that the adhesive release coating 42 covers only a portion of the area of the second side 38 of the backing layer 39. Consequently, the greater percentage of coverage of the adhesive release coating 42 along any given portion of the backing layer 39 reduces the adhesion between the backing layer 39 and the adhesive layer on the next inner sheet of the roller 20, and vice versa.

The circular pattern 56 for the adhesive release coating 42 illustrated in FIG. 6 is for exemplary purposes only. The pattern 56 may be of any desired shape or configuration and may be either a repetitive pattern, as illustrated in FIG. 6, a gradated pattern, or a completely random pattern. Furthermore, the pattern 56 of the adhesive release coating 42 may be either constant across the entire second side 34 of the backing layer 39 or, as shown, may vary in area coverage laterally across the backing layer 39. Furthermore, by laterally varying the percentage of coverage of the second side 34 of the backing layer 39, the degree of adhesion between the backing layer 39 and the adhesive layer on the next inner sheet may be varied as desired. For example, the area of coverage of the pattern 56 is preferably higher along the edges 34 of the backing layer 39 than in the center to facilitate removal of individual sheets from the roller 20 while maintaining good adhesion along the center of the roller to ensure the integrity of the roller during use.

Figure 12:
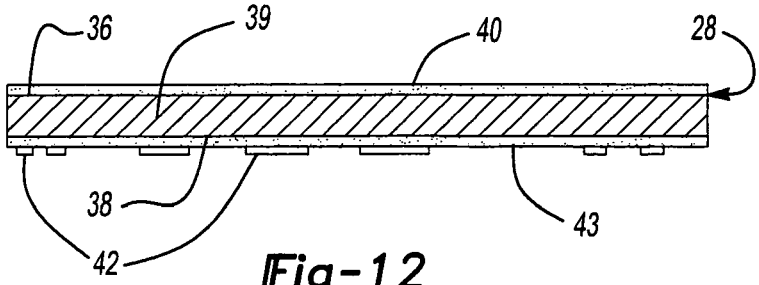
FIG. 12 is a view similar to FIG. 4, but illustrating a modification thereof.

With reference to FIG. 12, it will be understood that the adhesive release coating 42 may be applied directly to the second side 34 of the backing layer 39, or alternatively, may be applied over an underlying coat or coats 43 of an adhesive release material of a different strength.

Figure 7:
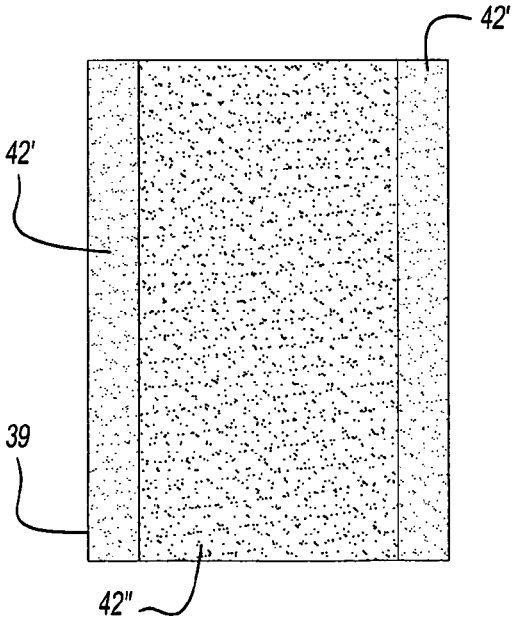
FIG. 7 is a view similar to FIG. 5 but illustrating a modification thereof.

With reference now to FIG. 7, a still further embodiment of the present invention is shown in which a first adhesive release coating 42' is provided along predetermined portions of the second side 38 of the backing layer 39 while a second and different adhesive release coating 42" is provided along other portions of the backing layer 39. For example, as illustrated in FIG. 7, the adhesive release coating 42' of a first release efficacy is provided along both edges while the second adhesive release coating 42" of a different release efficacy is provided along the center of the backing layer 39. The use of different types of adhesive release coatings varies the degree of adhesion between the backing layer 39 and the adhesive layer on the next inner sheet of the roller 20 to facilitate easy removal of the sheets from the roller 20 when desired, while maintaining the integrity of the roller 20 in use.

Optionally, the release coatings 42, 42' and/or 42" may be color tinted and thus visible to the user. The same, or different, color of tinting may be used for the different release coatings 42, 42' and 42". Furthermore, if desired, the release coating 42, 42' and/or 42" may be selectively tinted to form visible indicia, such as a company name or trademark. Such a company name or trademark may also, or alternatively, be printed onto the release coating 42, 42' and/or 42".

Figure 14:
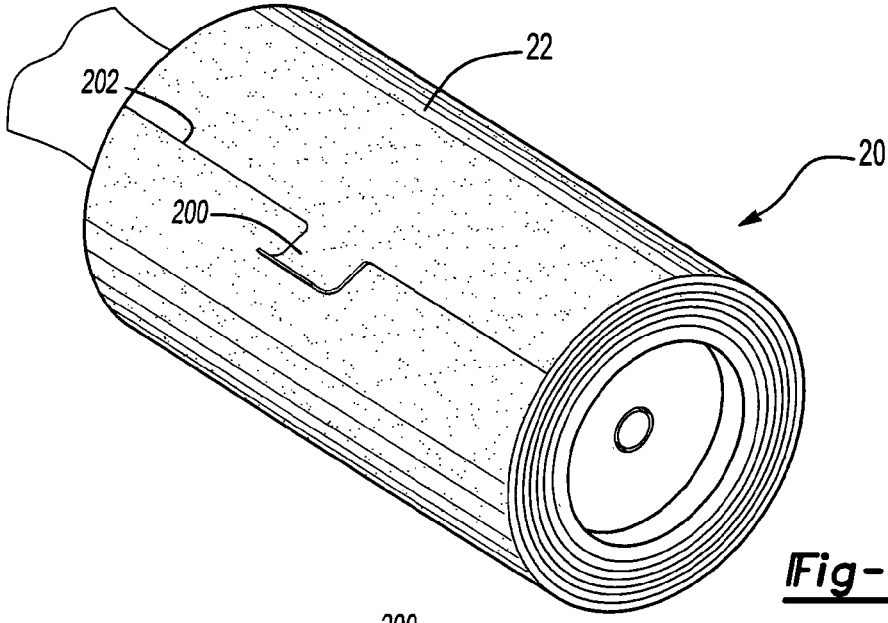
FIG. 14 is a view similar to FIG. 1, but illustrating a modification thereof.
Figure 15:
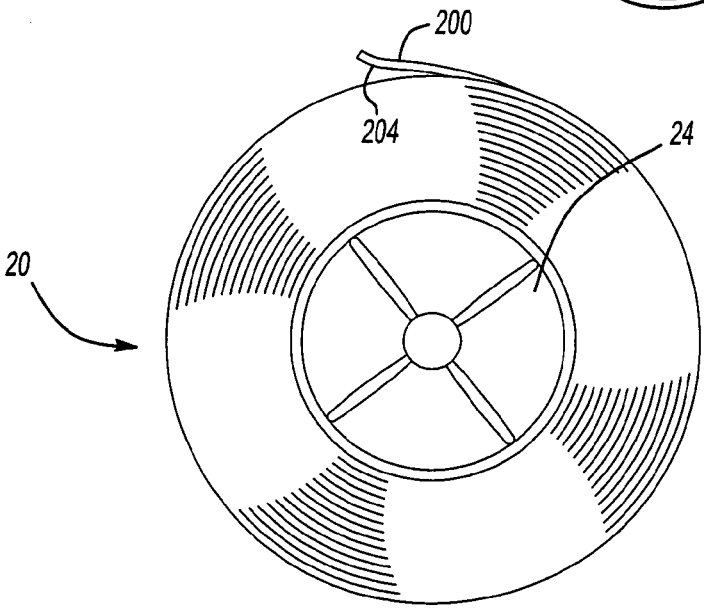
FIG. 15 is a view similar to FIG. 2, but illustrating a modification thereof.

With reference now to FIGS. 14 and 15, a still further modification is illustrated in which a tab 200 is formed through the backing layer at intervals corresponding to one revolution of the roller 20. The tab 200 protrudes outwardly from the perforation or cut line 202 formed through the strip to facilitate the removal of individual sheets from the roller 20.

As best shown in FIG. 15, a highly effective adhesive release coating 204 is applied to the inner side of the tab 200 so that the tab 200 exhibits little, if any, adhesion to the underlying layer on the roller 20. Consequently, the tab 200 "pops up" from the roller 20 and forms a pull tab to facilitate the removal of individual sheets from the roller 20. Alternatively, the highly effective release coating may be applied in a continuous step on the underside of the roller such that the strip is aligned with the tabs 200.

Figure 8:
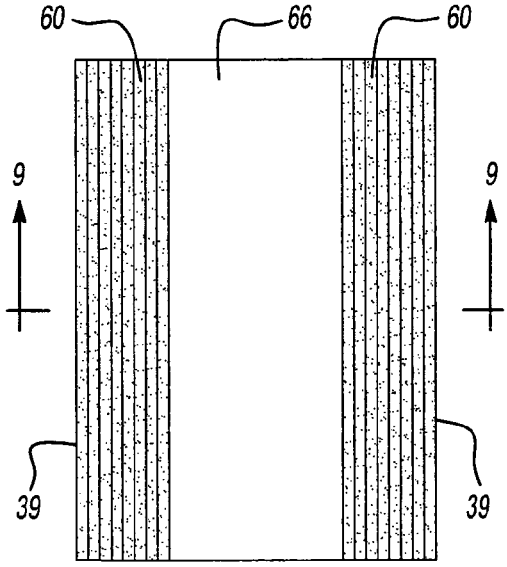
FIG. 8 is a view similar to FIG. 5 but illustrating a still further embodiment thereof.
Figure 9:
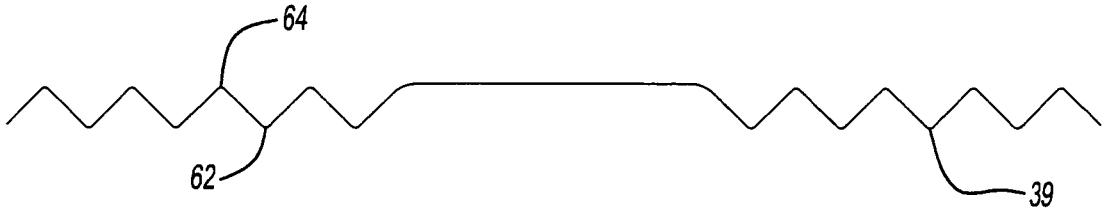
FIG. 9 is a view taken substantially along line 9-9 in FIG. 8.

With reference now to FIGS. 8 and 9, a still further embodiment of the present invention is shown in which portions 60 of the backing layer 39 are deformed by crimping to form alternating peaks 62 and valleys 64 (FIG. 9) along the backing layer 39. Consequently, when the strip 28 is wound into the cylindrical roller illustrated in FIGS. 1 and 2, the crimped portions 60 of the backing layer 39 reduce the area of contact between each layer or sheet of the backing layer 39 with the adhesive layer on the next inner sheet of the roller 20. By reducing and controlling the area of contact between the backing layer 39 and the adhesive layer on the next inner sheet, the degree of adhesion between adjacent layers or sheets on the adhesive roller 22 can be varied laterally across the strip 28 as desired between the sides 34 of the strip 28.

For example, as shown in FIGS. 8 and 9, only the outermost edges of the backing layer 39 are crimped thus reducing the adhesion between the edges of the backing strip 39 and the adhesive on the next inner layer or sheet of the roller 20 to facilitate easy removal of individual sheets from the roller 22 when desired. Conversely, a center portion 66 of the backing strip 39 is left uncrimped, or only partially crimped, to increase the strength of the adhesion between the center portion 66 of the backing layer 39 and the adhesive layer on the next inner roller in order to ensure integrity of the roller 20 during use.

If desired, the degree of crimping of the backing layer 39 may be maintained constant laterally across the backing layer 39 or may be varied as previously described. Additionally, an adhesive release coating may optionally be used in conjunction with the crimped portions 60 of the backing strip 39.

Figure 13:
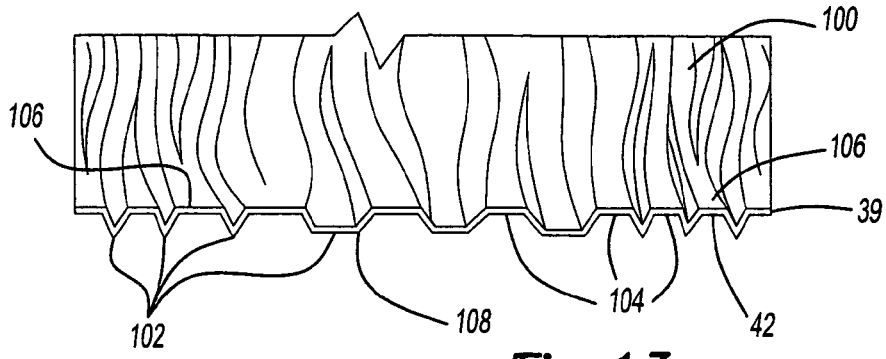
FIG. 13 is a view similar to FIG. 9, but showing a modification thereof.

With reference now to FIG. 13, a still further modification of the invention is shown in which the backing layer 39 is made of film or similar material by an extrusion process. As a part of the extrusion process, the extruded backing layer passes through an embossing roller 100 which embosses the backing layer 39 into alternating peaks 102 and valleys 104 so that the area of contact with the second side 42 of the backing layer 39 with the adhesive layer 40 on the next inner sheet of the roller varies in proportion with the area of contact between the peaks 102 and the adhesive layer 40. Furthermore, by varying the pattern of the embossing roller 100, the area of contact may be varied to produce minimal adhesion, as shown at areas 106, and stronger adhesion, as shown at area 108.

Figure 10:
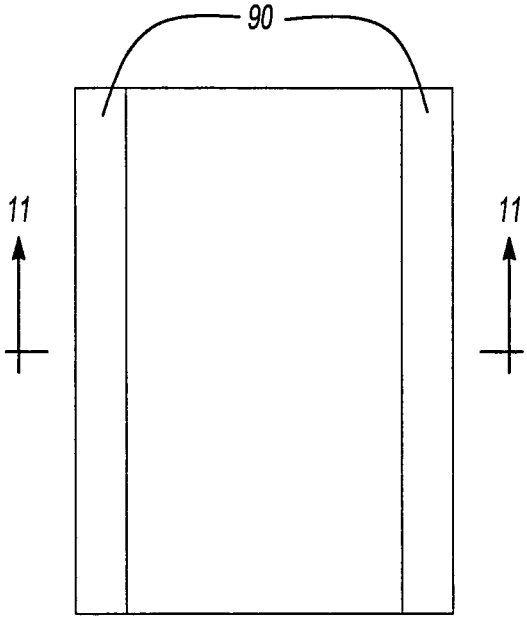
FIG. 10 is a plan view illustrating still a further embodiment of the present invention.
Figure 11:
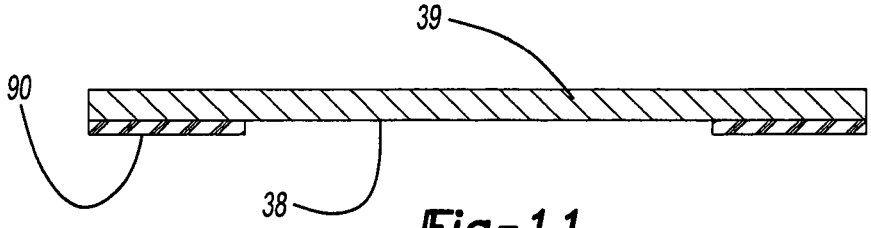
FIG. 11 is a sectional view taken substantially along line 11-11 in FIG. 10 and enlarged for clarity.

As thus far described, the adhesive release coating is in liquid form and applied to the second surface of the backing layer by zone coating. Alternatively, a solid adhesive release substrate 90 may be applied to the second side 38 of the backing layer 39 as shown in FIGS. 10 and 11. Such a release substrate 90 may be applied to selected portions of the backing layer 39 or, alternatively, may be applied in a pattern such as along the edges as shown in FIGS. 10 and 11.

In lieu of crimping the backing layer 38, the backing layer may be deformed by embossing to form a pattern of peaks and valleys on the backing layer. Such embossment is particularly advantageous when the backing layer is a film.

From the foregoing, it can be seen that the present invention provides an adhesive roller for detritus removal which advantageously provides increased efficiency of the adhesive roller since the outermost surface of the adhesive roller is completely covered with an adhesive. The present invention achieves this while still maintaining easy removal of individual sheets from the adhesive roller. Having described my invention, however, many modifications thereto will become apparent to those skilled in the art to which it pertains without deviation from the spirit of the invention as defined by the scope of the appended claims.

We claim:

1. An adhesive roller construction for detritus removal comprising:

an elongated strip, said strip having a hacking layer and an adhesive layer overlying and covering a first side of said backing layer, said strip having a first end, a second end and two spaced apart sides, a first adhesive release coating overlying a first portion of a second side of said backing layer, said first adhesive release coating having a first release efficacy, a second adhesive release coating which covers a second portion of said second side of said backing layer, said second portion being a different area of the second side of said backing layer than said first portion, said second adhesive release coating having a second release efficacy different from said first release efficacy, wherein said strip is wound from said first end to said second end into a tubular cylindrical roller with said adhesive layer facing outwardly, and wherein at least a portion of one of said adhesive release coatings is color tinted.

2. The adhesive roller as defined in claim 1 wherein said backing layer comprises paper.

3. The adhesive roller as defined in claim 1 wherein said first adhesive release coating comprises silicone.

4. The adhesive roller as defined in claim 1 wherein said first adhesive release coating is applied in a pattern of adhesive release material to said second side of said backing layer so that only a portion of said second side of said backing layer contacts the outwardly facing adhesive layer of an underlying layer of the roller.

5. The adhesive roller as defined in claim 1 wherein said first adhesive release coating is applied in a pattern of adhesive release material to said second side of said backing layer so that only a portion of said second side of said backing layer is covered with the adhesive release material.

6. The adhesive roller as defined in claim 1 wherein a greater percentage of the area of the second side of the strip along the center of the strip is covered with said first adhesive release coating than adjacent the sides of the strip.

7. The adhesive roller as defined in claim 1 wherein said first adhesive release coating is applied in a pattern of adhesive release material to said second side of said backing layer, said pattern having alternating peaks and valleys which provide discontinuous contact between said adhesive release material and the outwardly facing adhesive layer of an underlying layer of the roller.

8. The adhesive roller as defined in claim 1 wherein said first adhesive release coating covers only a portion of a second side of said strip.

9. The adhesive roller as defined in claim 8 wherein said portion of said second side of said strip includes the portion immediately adjacent each side of said strip.

10. The adhesive roller as defined in claim 1 wherein said first adhesive release coating is selected from the group of silicone, wax, lacquer, paint, ink, oil, soap and mixtures thereof.

11. The adhesive roller as defined in claim 1 wherein said first adhesive release coating exhibits different adhesive release tendencies than said second adhesive release coating.

12. The adhesive roller as defined in claim 1 wherein said tinted portion of said first adhesive release coating forms indicia.

13. The adhesive roller as defined in claim 1 and comprising printed indicia on said first adhesive release coating.

14. An adhesive roller construction for detritus removal comprising:

an elongated strip, said strip having a backing layer and an adhesive layer overlying and covering a first side of said backing layer, said strip having a first end, a second end and two spaced apart sides, a first adhesive release coating overlying a first portion of a second side of said backing layer, said first adhesive release coating having a first release efficacy, a second adhesive release coating which covers a second portion of said second side of said backing layer, said second portion being a different area of the second side of said backing layer than said first portion, said second adhesive release coating having a second release efficacy different from said first release efficacy, wherein said strip is wound from said first end to said second end into a tubular cylindrical roller with said adhesive layer facing outwardly, and printed indicia on at least one of said adhesive release coatings.

* * * * *